United States Patent [19]

Hasse et al.

[11] 4,345,295

[45] Aug. 17, 1982

[54] ARRESTER WITH SPARK GAP

[75] Inventors: Peter Hasse, Neumarkt; Johannes Wiesinger, Puchheim; Erich Pivit, Allmersbach, all of Fed. Rep. of Germany

[73] Assignees: Dehn & Söhne & Co. KG, Nuremberg; Aeg-Telefunken Aktiengesellschaft, Frankfurt and Berlin, both of Fed. Rep. of Germany

[21] Appl. No.: 179,706

[22] Filed: Aug. 20, 1980

[30] Foreign Application Priority Data

Aug. 24, 1979 [DE] Fed. Rep. of Germany ..... 2934236

[51] Int. Cl.[3] ..... H01T 5/00

[52] U.S. Cl. ..... 361/130; 313/231.1

[58] Field of Search ..... 361/117, 121, 122, 130; 313/231.1, 231.2

[56] References Cited

U.S. PATENT DOCUMENTS 2,628,322 2/1953 Yonkers, Jr. ..... 361/130 X 2,907,910 10/1959 Marsteller ..... 313/231.1

3,141,108 7/1964 Benner et al. ..... 313/231.2

OTHER PUBLICATIONS

"L. V. Expulsion Arrester", Szpor, *Archiwum Elektrotechiniki* 1976.

*Primary Examiner*—Harry E. Moose, Jr.

*Attorney, Agent, or Firm*—Spencer & Kaye

[57] ABSTRACT

In an arrester for limiting overvoltages in a low voltage power system and for coupling conductors which are normally resistively separated from one another for lightning protection, which arrester includes at least two electrodes spaced apart to define at least one spark gap forming an arc discharge region, and an insulating member holding the electrodes in spaced-apart relation, there is provided a chamber adjacent the arc discharge region and having a chamber wall of an insulating material which emits a quenching gas under the effect of heat and which is provided with at least one outlet aperture through which the gases emitted under the effect of the heat generated during arc discharge can escape.

13 Claims, 5 Drawing Figures

Fig. 1b
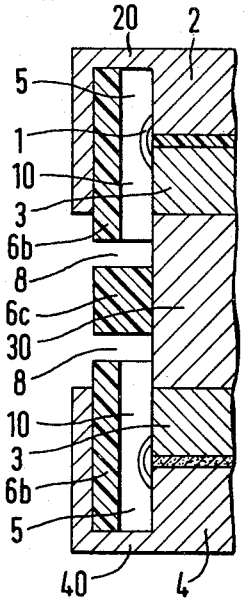
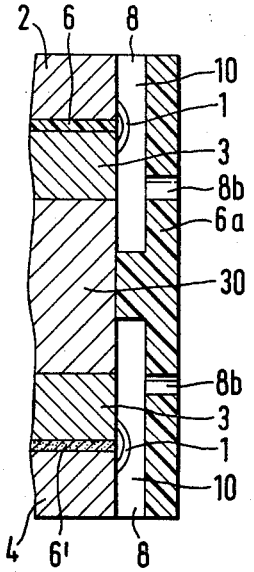
Fig. 1a
Fig. 2b
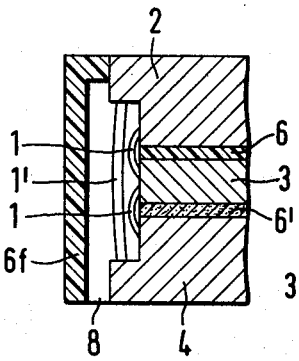
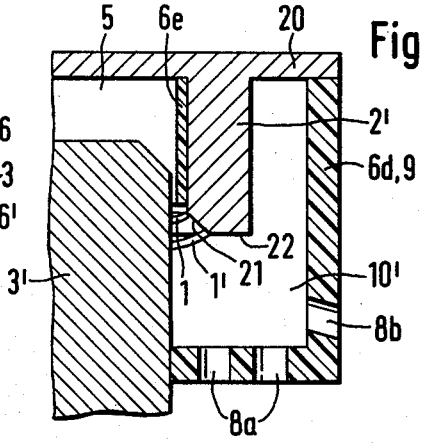
Fig. 2a
Fig. 3
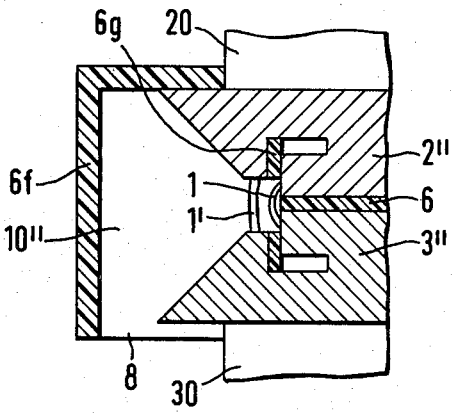

ARRESTER WITH SPARK GAP

BACKGROUND OF THE INVENTION

The present invention relates to an arrester, especially for limiting overvoltages in low-voltage installations and for coupling resistively separated circuits for the purpose of lightning protection, the arrester presenting at least one spark gap, formed between two electrodes which are held spaced apart by means of an insulating element.

Arresters are known, as described, for example in FRG DOS 2,337,743 and 2,627,648 in which the flashover, or arc-over, point is formed in an external zone either between the outer surfaces of the preferably planar, disk-shaped electrodes, the end faces of which are held at a spacing by an insulating layer, or between the outer surface of one electrode and the end face of the other electrode. In such an arrester, it is advantageous that the energy released during flashover can be quickly dissipated and thus danger of explosion can be prevented. However, one disadvantage is that the quenching characteristic for mains currents following the flashover is not optimal.

SUMMARY OF THE INVENTION

It is an object of the present invention to provide an inexpensive arrester having an improved quenching characteristic for such following currents.

This and other objects are achieved, according to the invention, in an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, by providing the arrester with means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape.

The arrester of this invention offers the advantage that the energy occurring during flashover is utilized, in a chamber adjoining the arc zone and presenting apertures, for generating quenching gas from the chamber walls consisting of an appropriate insulating material, in such a way that the arc is urged away from the gap and the ionized gases are blown off toward the outside; accordingly, no further ignition can take place after the end of the overvoltage, or voltage surge, due to the mains voltage. In the additional developments of this invention, a "broad-band" quenching characteristic, i.e. for any desired amperages, is attained by corresponding geometrical designs of the electrodes and the chambers surrounding same.

BRIEF DESCRIPTION OF THE DRAWING

FIGS. 1*a*, 1*b*, 2*a*, 2*b* and 3 each constitutes a cross-sectional view of one-half of a respective axially symmetrical embodiment of the invention.

DESCRIPTION OF THE PREFERRED EMBODIMENTS

FIGS. 1*a* and 1*b* show two embodiments of arresters constituted by electrode arangements defining two series-connected spark gaps as disclosed in FRG DOS 2,627,648. Each arc discharge zone 1 is located between the outer surfaces of pairs of disc-shaped electrodes 2 and 3 or 3 and 4, respectively, held by spaced-apart insulating discs 6 and 6', with electrodes 3 being connected together by a connecting element 30. A hollow cylinder **6*a* or cylinders 6*b* consisting of a gas stored in the solid phase or a similar material generating a gas under the effect of heat and provided with outlet openings 8, 8*b*** disposed around the electrodes and/or the arc zone produce the results that, due to the heat of the arc, a quenching gas is generated and the arc is urged somewhat toward the outside and quenched after the overvoltage has ceased. Therefore, after the mains voltage reappears, no renewed ignition can take place.

Possible materials for the elements 6, **6*a*, *b***, are teflon and POM (Polyoxymethylen), the evaporation temperature of both materials is about 300° C. and arc current of at least 300 A is needed.

In FIG. 1*a*, a single hollow cylinder **6*a* is provided around both arc gaps, whereby the arc gaps are isolated from each other so that arcs thereacross cannot combine. The hollow cylinder 6*a* has annular outlet openings 8 at the top and bottom and outlet openings 8*b* in the form of bore holes on its lateral surface. The insulating disc 6 of the upper spark gap can likewise consist of a gas in solid phase or a similar material, emitting a gas under the thermal influence of the arc in zone 1**. By means of such a spacer disc, an additional improvement in quenching characteristic is attained.

The spacer disc 6' of the lower spark gap between the electrodes 3 and 4 does not consist of a gas in the solid phase but rather of mica. This affords the advantage that the dual spark gap exhibits the required insulation resistance even after the gas of separator 6 of the upper spark gap has been burnt off or melted after a long-term usage and can no longer adequately insulate the electrodes 2 and 3 from each other.

FIG. 1*b* shows another embodiment of a dual spark gap wherein each spark gap is surrounded by a hollow cylinder **6*b*. Each hollow cylinder is mounted at a respective one of outer electrodes 2 and 4 by being inserted in likewise hollow-cylindrical extensions 20 and 40 thereof, in such a way that there is only one aperture located at the connecting element 30 of the two electrodes 3. By means of an annular member 6*c* of insulating material disposed around, and supported by, the connecting element 30, the two spark gaps are likewise isolated from each other, so that their arcs cannot combine. By this arrangement of electrodes and insulating element, a chamber-like zone 5 is created around each outer electrode 2 and 4 wherein an excess gas pressure can be generated during the arc discharge. This excess gas pressure can be dissipated via the annular duct 10** of FIG. 1*a* or past the annular insulating element **6*c*** of FIG. 1*b*, and through the associated aperture 8, which has the shape of an annular band, thus cleanly blowing out the arc discharge zone.

FIG. 2*a* shows another embodiment of the invention in which an electrode 2' having the form of a hollow cylinder and closed at the top is inverted over a solid cylindrical lower electrode 3' in such a way that a closed chamber 5 is produced between corresponding electrode end faces, and an arc discharge can take place between the lateral electrode surfaces in the zone 1. Directly adjoining the zone 1 of the arc discharge, a likewise hollow-cylindrical member **6*e* having a gas stored in the solid phase is arranged between the lateral surfaces to prevent the arc from migrating into the chamber 5 and, especially at higher current levels, to assure that the arc is urged downwardly into the zone 1' between the outer lateral surface of the lower inner electrode 3' and the beveled surface 21 and/or the lower end face 22 of the electrode 2'**.

The electrode 2' is provided at the top with a disc-shaped outward extension 20. Between the latter and the lower end of the electrode 3, a hollow cylinder **6*d* having a gas stored in the solid phase and closed at one end is arranged as a spacer, maintaining the electrodes in their desired relative positions and forming an annular chamber 10'. The solid-gas cylinder has borehole-shaped openings 8*a* and 8*b* at its bottom and lateral surfaces, through which can escape the gases generated during the arc discharge, the excess pressure produced in the chamber 5** contributing toward a clean blow-out of the arc discharge zone.

FIG. **2*b* shows an advantageous embodiment of the invention wherein three disc-shaped electrodes 2, 3 and 4, insulated from each other and spaced apart by means of disc-shaped spacers 6 and 6' are superimposed upon one another. The two resulting spark gaps are surrounded by a hollow cylinder 6*f*, having gas stored in the solid phase and closed at the top in such a way that an annular outlet aperture 8 remains around the lower electrode 4. The two outer electrodes 2 and 4 exhibit an abrupt change in diameter at a certain distance from their associated spark gaps. In this connection, it is especially advantageous that, due to the lack of isolation between the two spark gaps, the two individual arc-over paths 1 are combined already shortly after ignition, approximately after 20 microseconds, so that an arc discharge takes place only between the points of abrupt change in diameter of the two outer electrodes 2 and 4, in the zone 1'. This arc is urged magnetically against the gas emitting wall 6*f*, is strongly cooled at that location, and blown out through opening 8**.

In this way, a stable arc is formed at a medium spacing from the middle electrode. In this process, there is hardly any discharge at the gaps between the electrodes and/or at the rims thereof, so that burn-off takes place only to a particularly minor extent.

If one of the electrode spacers 6 contains a gas stored in the solid phase and the other spacer 6' is of mica, then such an arrester according to the invention exhibits, in combination, a high reliability, a long lifetime, and an optimum quenching characteristic for mains following currents.

In FIG. 3, another embodiment of this invention is illustrated wherein two disc-shaped electrodes 2'' and 3'' are separated by an insulating element 6 of identical diameter containing a gas stored in the solid phase. The two electrodes 2'' and 3'' and their terminals 20 and 30 are surrounded by a hollow cylinder **6*f* which is closed at its upper end, presents an annular outlet passage 8, opening in the downward direction and contains gas stored in the solid phase producing quenching gas under the thermal effect of the arc. With this arrangement, an excess pressure is generated in the chamber 10'' which is formed by cylinder 6*f*** and is located in front of the arc zone. This excess pressure has a favorable effect on the quenching of the arc.

At a certain mutual distance, the two electrodes 2'' and 3'' have an abrupt change in diameter and exhibit a subsequent progressive increase in diameter with increasing mutual spacing. In this way, the arc can develop with increasing current level from the zone 1 between the lateral surfaces of the electrodes 2 and 3 toward zone 1' at the outside.

At the location where each electrode has an abrupt change in diameter, a gap which may have an axial and a radial portion is provided to assure that the high thermal energy evolving at large currents in the outward arc zone 1' cannot pass via the adjoining electrode portions to the spacer 6 and destroy the latter prematurely. In a further development of the invention, this gap is not only filled by air but additionally with an element **6*g*** containing gas stored in the solid phase, whereby an increased blowing effect is attained for the quenching of the arc.

The material of electrodes 2, 3, 4 is copper-tungsten (20–80), the diameter of the electrodes is between 20 to 30 mm with a thickness of 3 to 5 mm. The spacers 6, 6', **6*a, b*** have a slightly greater diameter and a thickness of 0.5 mm. The insulation resistance is about 10 MΩ and the breakdown voltage is 1.5 kV and the arc discharge voltage about 30 to 50 V.

It will be understood that the above description of the present invention is susceptible to various modifications, changes and adaptations, and the same are intended to be comprehended within the meaning and range of equivalents of the appended claims.

What is claimed is:

1. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement wherein there are at least three said electrodes arranged in sequence to define at least series-arranged spark gaps, and said arrester comprises: means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape; and means mounted for isolating said spark gaps from one another with respect to arc discharge.

2. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement comprising means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape, and wherein said insulating means comprises a body interposed between said electrodes and located adjacent the arc discharge region, said body being of a material which emits a quenching gas under the effect of heat generated by an arc discharge, each of said electrodes and said body has the form of a disc, each of said discs has the form of a circular cylinder, and all of said discs have the same diameter.

3. Arrester as defined in claim 2 further comprising means defining a second chamber adjacent the arc discharge region and providing a chamber wall of an insulating material which emits a quenching gas under the effect of heat, with said first and second chambers being located to respectively opposite sides of the arc discharge region.

4. Arrester as defined in claim 3 wherein said chambers have an annular form and surround said electrodes and arc discharge region.

5. Arrester as defined in claim 2 wherein said wall of said first chamber has the form of a cylinder open at one axial end to define said aperture.

6. Arrester as defined in claim 2 wherein there are at least three said electrodes arranged in sequence to define two series-arranged spark gaps.

7. Arrester as defined in claim 6 or 1 wherein said insulating means comprise a mica spacer located in one of said spark gaps between said electrodes defining said one spark gap.

8. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement comprising means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape, and wherein said insulating means comprises a body interposed between said electrodes and located adjacent the arc discharge region, said body being of a material which emits a quenching gas under the effect of heat generated by an arc discharge, and one of said electrodes has the form of a solid cylinder while the other of said electrodes and said body have the form of hollow cylinders.

9. Arrester as defined in claim 8 wherein said chamber wall simultaneously constitutes said insulating means.

10. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement comprising means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape, and wherein said wall of said first chamber has the form of a cylinder provided with a plurality of said apertures in the form of openings in at least one of the cylindrical surface and an end surface of said cylinder.

11. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement comprising means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape, and wherein there are at least three said electrodes arranged in sequence to define two series-arranged spark gaps, and said insulating means comprise a mica spacer located in one of said spark gaps between said electrodes defining said one spark gap.

12. Arrester as defined in claim 11 wherein said insulating means further comprise a body located in the other one of said spark gaps between said electrodes defining said other spark gap, said body being of a material which emits a quenching gas under the effect of heat generated by an arc discharge.

13. In an arrester for limiting overvoltages in a low voltage power system and for coupling conductors which are normally resistively separated from one another for lightning protection, which arrester includes at least two electrodes spaced apart to define at least one spark gap forming an arc discharge region, and insulating means holding the electrodes in spaced-apart relation, the improvement comprising means defining a first chamber adjacent the arc discharge region and providing a chamber wall of an insulating material which emits a quenching gas under the effect of heat and provided with at least one outlet aperture through which the gases emitted under the effect of the heat generated during arc discharge can escape, and wherein there are at least three said electrodes arranged in sequence to define two series-arranged spark gaps, and each said electrode has a cylindrical form and the outermost electrodes of said sequence have an outer diameter which changes abruptly at a selected point in their axial direction.

* * * * *